US007534040B2

(12) United States Patent
Brans et al.

(10) Patent No.: US 7,534,040 B2
(45) Date of Patent: May 19, 2009

(54) BAG MADE OF FILM MATERIAL

(75) Inventors: Albert Brans, Voorschoten (NL); Marcel Peter Magermans, Den Haag (NL)

(73) Assignee: Heineken Technical Services B.V., Zoeterwoude (NL)

( * ) Notice: Subject to any disclaimer, the term of this patent is extended or adjusted under 35 U.S.C. 154(b) by 732 days.

(21) Appl. No.: 10/505,326

(22) PCT Filed: Feb. 19, 2003

(86) PCT No.: PCT/NL03/00124

§ 371 (c)(1),
(2), (4) Date: Feb. 7, 2005

(87) PCT Pub. No.: WO03/070594

PCT Pub. Date: Aug. 28, 2003

(65) Prior Publication Data

US 2005/0117818 A1 Jun. 2, 2005

(30) Foreign Application Priority Data

Feb. 21, 2002 (NL) ..... 1020027

(51) Int. Cl.
*B65D 30/20* (2006.01)

(52) U.S. Cl. ..... 383/120; 383/67; 383/107; 383/116; 383/121; 383/122; 383/906; 222/90; 222/105

(58) Field of Classification Search ..... 383/67, 383/107, 116, 120, 121, 122, 906; 222/90, 222/105

See application file for complete search history.

(56) References Cited

U.S. PATENT DOCUMENTS

| | | | | |
|---|---|---|---|---|
| 4,264,018 | A | 4/1981 | Warren | |
| 5,248,063 | A | 9/1993 | Abbott | |
| 5,865,540 | A * | 2/1999 | Derby et al. | 383/24 |
| 6,036,365 | A * | 3/2000 | Imer | 383/104 |
| 6,195,964 | B1 * | 3/2001 | Kitao | 53/449 |

FOREIGN PATENT DOCUMENTS

| | | |
|---|---|---|
| AU | 529 320 B | 6/1983 |
| NL | 7 011 940 | 2/1972 |
| WO | WO 92 22472 | 12/1992 |

* cited by examiner

*Primary Examiner*—Nathan J Newhouse
*Assistant Examiner*—Jack H Morgan, Jr.
(74) *Attorney, Agent, or Firm*—Young & Thompson

(57) ABSTRACT

A bag for placing in a cylindrical or barrel-shaped container includes front and rear panels (11, 12) between which side panels (13, 14) folded double are positioned. The base of the bag runs to a point along edges (17, 18). When the bag is unfolded this is able to come into contact with the inside wall of a cylindrical or barrel-shaped container having a round base and neck without significant stresses. As a result high material stresses are avoided and the barrier properties of the bag are retained. The front and rear panels (11, 12) can be joined to one another by breakable fastening lips (22, 23).

9 Claims, 6 Drawing Sheets

BAG MADE OF FILM MATERIAL

This is a 371 National Stage application of International application No. PCT/NL03/00124, filed Feb. 19, 2003, which claims priority to Netherlands application No. 1020027, filed Feb. 21, 2002. The entire contents of the above- referenced applications are hereby incorporated by reference in their entirety.

The invention relates to a bag made of film material as well as to a method for the production of such a bag.

BACKGROUND OF THE INVENTION

NL 1 015 368 discloses a holder for containing drink such as, for example, beer, having an essentially cylindrical container provided with a curved base and neck with a bag made of flexible film material therein. The bag has a shut-off valve through which carbonated drink is introduced into the bag from a fill line via a filler head. The carbonated drink can be dispensed from the bag by applying an elevated pressure between the outside wall of the bag and the inside wall of the container.

After the bag has been introduced into the outer, rigid container in the folded and rolled-up state via the neck, the bag is filled. When filling the bag via the neck of the rigid outer container it is important that the bag unfolds uniformly and makes close fitting contact with the inside wall of the container. If non-uniform unfolding of the bag takes place during filling, it can happen that parts of the bag inside the container stick to the container wall in an undesired position. As a result stresses can arise in the bag that are so high that the barrier properties of the bag material, especially if a laminate of plastic and aluminium is used for the bag, are adversely affected by perforations of the bag material. If the bag is only partially filled, the pressure can increase to such an extent that the bag tears. In order to position the bag in the outer container in a stable manner it is important that the bag is in uniform contact with the inside wall of this container at all points. This is also important for uniform distribution of the stress in the film material of the bag.

In WO 01/00502 a method is described with which the flexible bag is divided by break means, such as, for example, an adhesive tape or welds, into various compartments which come apart successively by the fill pressure during filling. As a result a central part of the bag can first be filled over the entire length thereof, after which the lateral compartments are freed and become accessible to the drink, so that after vertical filling of the central compartment the side walls engage closely with the inside wall of the container.

SUMMARY OF THE INVENTION

One aim of the present invention is to provide a bag made of film material that is able to make close fitting contact with an essentially cylindrical container having a curved top and/or bottom.

A further aim of the invention is to provide a bag made of film material where the stresses are uniformly distributed over the film material when the bag is in the filled state, so that damage to the bag material can be avoided and the barrier properties of the bag material are retained, which bag can be produced in a simple manner.

A further aim of the invention is to provide a bag made of film material provided with break means that enable controlled unfolding during filling of the bag.

To this end, the bag according to the invention, in the unfolded state, has an essentially rectangular mid section, a front panel and a rear panel extending from two opposing side edges of the mid section, and having (sic), at right angles to the front panel and rear panel, two side panels that extend from two further side edges of the mid section, each panel being provided with two side edges and with an end edge located some distance away from the mid section, wherein, when the bag is in the made-up state, the side panels are folded along their centre line, as well as along two fold lines that run from the corner points of the mid section located close to the respective side panel into or close to the centre of the mid section, wherein the side panel halves located on either side of the centre line of the side panels are positioned with their outsides facing one another and wherein the front and rear panels are folded about the centre line of the mid section and are positioned with their insides facing one another, wherein the double-folded side panels are located between the front panel and the rear panel, the longitudinal edges of the side panels are in contact with the adjacent longitudinal edges of the front and rear panels, and the side panels, [lacuna] the front and rear panels are sealed to one another along the longitudinal edges and along the end edges.

The bag according to the invention can be made from a sheet of film material by, before folding or after the folding process is complete, cutting out the front, rear and side panels in accordance with a pattern in the shape of a cross. By folding the side panels double and placing these between the front and rear panels located on top of one another a flat configuration is obtained that on unfolding forms a three-dimensional bag that at the end edges, the longitudinal edges and the fold lines is in close-fitting contact with, respectively, the curved base, the sidewalls and the curved neck of the outer container.

Furthermore, the bag according to the invention can be produced in a simple manner and on filling with drink inside the rigid container it distributes the stresses in a uniform manner.

Preferably, the end edges of the bag in the flat, made-up state are pointed, so that when the bag unfolds these edges are able to extend along a curved surface.

In one embodiment the bag comprises a laminate of a metal foil layer and a plastic layer, the plastic layer being located on the inside of the bag, which plastic provides the seal between the panels by the application of heat along the longitudinal edges and along the end edges. The longitudinal edges and end edges placed on top of one another can be sealed to one another by supplying pressure and heat. Preferably, a hole is made in the film material at or close to the centre of the mid section, a tube extending in the interior of the bag, which tube is connected to a shut-off valve located outside the bag and is joined to the periphery of the hole to provide a seal. All drink can be removed from the bag through the riser tube by compressing the bag filled with drink.

In an advantageous embodiment the bag has two fastening lips on opposing longitudinal edges of a panel, which fastening lips extend laterally with respect to the longitudinal edges and are placed on top of one another and joined to one another such that they can come apart. When the bag is in the flat, made-up state, the front panel and rear panel can temporarily be joined to one another by the fastening lips, so that when a bag placed in a cylindrical container is filled with drink the front and side panels come apart from one another when a predetermined fill pressure is reached and the bag is able to unfold uniformly and completely fill with the drink.

The fastening lips can be formed on the longitudinal edges of the front and back panels and extend laterally beyond these, so that the fastening lips placed on top of one another with their plastic inside can be joined to one another by hot welding. The weld points can be spaced apart. Preferably, the fastening lip on one side of the front and rear panel is longer than the fastening lip on the opposite side. As a result of this asymmetric arrangement, optimum filling of the bag and controlled release of the bag volume can be achieved, so that close-fitting contact with the inside wall of the container takes place and the bag is at least virtually completely filled.

In a further advantageous embodiment where the bag is made with minimum loss of material, the side panels are welded individually to the front and rear panels. The side panels and the front and rear panels are fed in parallel as three individual webs, the webs for the side panels being relatively broad and cut off relatively short, whilst the central web for the front and rear panels if cut off relatively long and is relatively narrow.

A few embodiments of a bag according to the invention, as well as the method for the production thereof, will be explained in more detail with reference to the appended drawing. In the drawing:

DETAILED DESCRIPTION OF THE INVENTION

Figure 1:
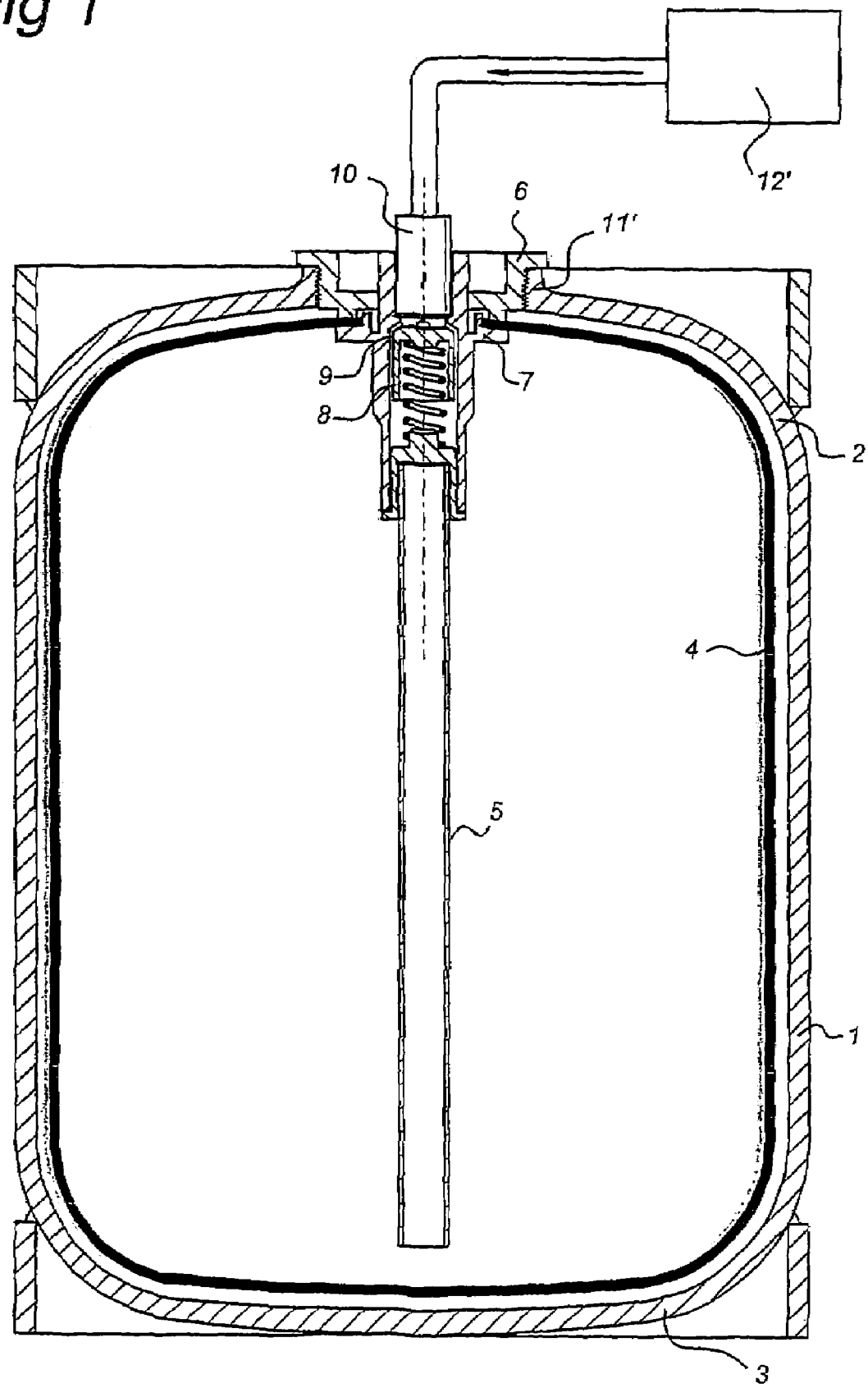
FIG. 1 shows a diagrammatic section of a plastic holder with a curved base and neck provided with a bag according to the invention.

FIG. 1 shows a holder for carbonated drink, in particular beer, as is described in more detail in NL 1 015 368. The holder comprises an outer rigid container 1, which, for example, is made of plastic such as POM or PET. The container 1 has a round shoulder 2 and a round base 3. A bag 4 made of film material has been placed in the container 1, which bag fits closely against the inside walls of the container 1. The bag 4 is provided with a plastic riser tube 5. At an upper end the bag 4 is joined to a plastic shut-off valve 6 via a flange 7 that is welded to the bag. The shut-off valve 6 comprises a valve 8 with an outlet 9 for filling the bag via a filler head 10 of a filling device 12', which is not indicated in more detail in this figure. When the bag 4 is filled, the bag and the container 1 are placed upside-down. After filling, the drink is dispensed from the bag 4 by placing the container in a drink dispenser that, after removal of the filler head 10, operates the valve 8 for controlled and metered dispensing of drink from the bag. For dispensing drink, air is fed via the shut-off valve 6 into the space between the bag 4 and the container 1, as a result of which the bag is emptied under pressure by the air pressure inside the container 1 when its contents are dispensed. The bag 4 with the shut-off valve 6 joined thereto is suitable for one-off use and after it has been emptied it is removed from the container 1 via the neck 11'. A new folded and rolled-up bag 4 is then introduced into the bottle (sic) through the neck 11'. This folded-up bag is unfolded in a controlled manner by filling via the filling head 10, such that the bag is completely filled and is uniformly and completely in contact with the inside walls of the container 1 and is able to follow the contours of the curved shoulder 2 and curved base 3. According to the invention the geometry of the bag 4 is tailored in order to obtain an optimum match to the shape of the barrel-shaped or cylindrical container 1 with rounded shoulder 2 and base 3.

Figure 2:
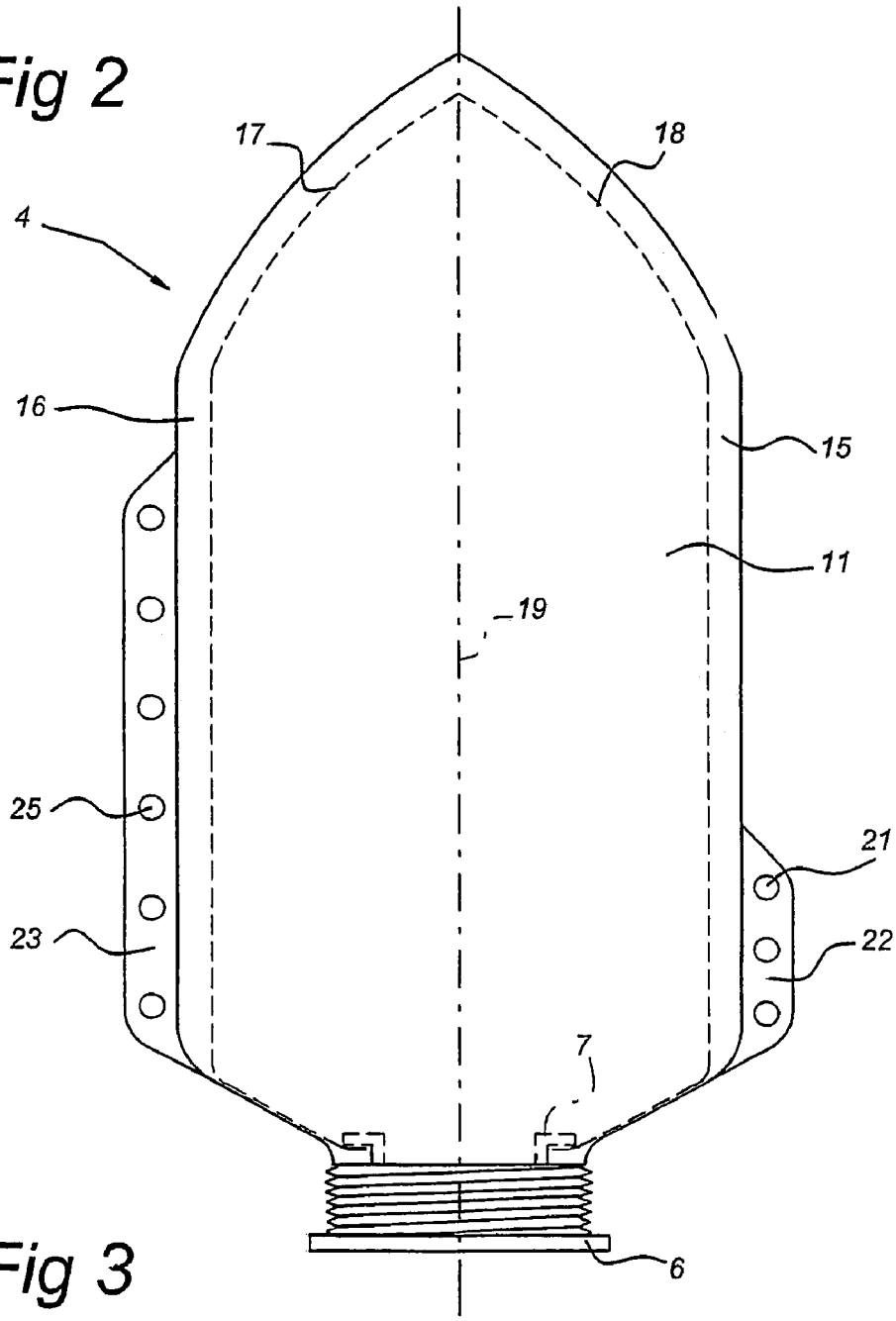
FIG. 2 shows a front view of a bag according to the invention.

FIG. 2 shows a plane front view of the bag 4 with the plastic shut-off valve 6. The bag 4 is made of a laminate of aluminium and plastic layers. As can be seen from FIG. 3, in the folded and made-up state, the bag is made up of a front panel 11, a rear panel 12 with the side panels 13 and 14 folded double between the front and rear panels 11, 12. The front panel 11 has two longitudinal edges 15, 16 and two end edge sections 17, 18, which, from the longitudinal edges 15, 16, run to a point towards the centre line 19 of the bag. Furthermore, fastening lips 22, 23, which join the front panel 11 and the rear panel 12 to one another in a breakable manner, are provided on the bag along the longitudinal edges 15, 16. When the bag 4 is filled the fastening lips 22, 23 come apart, so that gradual and controlled filling of the bag is achieved without folds and spaces that are only partially filled or are not filled at all being produced as a result and so that non-uniform contact with the wall of the container 1 is prevented from taking place. Such non-uniform contact during filling can generate high stresses in the material and, as a result of overstretching, can give rise to small tears in the aluminium of the bag film, as a result of which the (gas) barrier diminishes, or can even give rise to tearing of the bag, especially at the point of attachment to the flange 7, this being prevented by the fastening lips 22, 23. Furthermore, as a result of the stiff seams of the fastening lips 22, 23 an edge is formed that is located some distance away from the inside of the container wall, so that an air channel is formed through which air is able to escape from the container 1 during filling.

Figure 3:
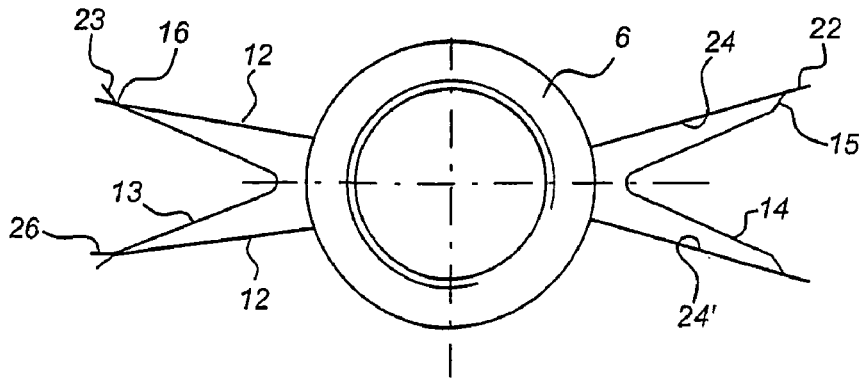
FIG. 3 shows a diagrammatic plan view of the bag according to FIG. 2.

As can be seen from FIG. 3, the fastening lips can be formed by allowing the front panel and rear panel 11, 12 to protrude beyond the side panel 14 along the longitudinal edges. As a result the insides 24, 24' of the front and rear panels come into contact with one another, which insides are made of plastic material. The plastic material of the front and rear parts of the fastening lip 22 can be joined in a breakable manner by means of spot welding 21. Alternatively, both the front and rear panels 11, 12 and side panels 13, 14 can protrude beyond the longitudinal edge 15, 16 to form a fastening lip, such as, for example, is shown at 23. In this case the outside 26 of the side panel 13 is joined to both the front and rear panels at the fastening lip parts by means of spot welding 25 or using another joining technique, such as applying adhesive or making perforations.

Figure 4:
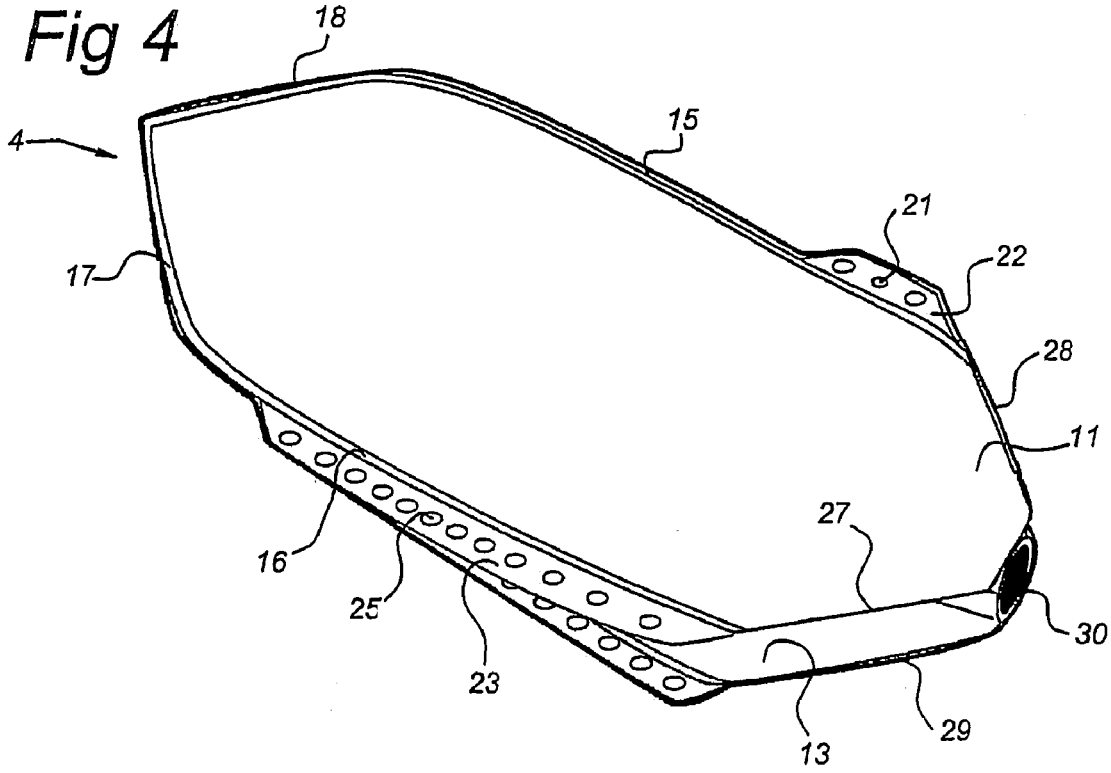
FIG. 4 shows a perspective view of the bag according to FIG. 2.

FIG. 4 gives a perspective view of the bag 4 according to FIGS. 2 and 3, where the shut-off valve 6 and the riser tube 5 have been removed from the bag. It is clear that the bag 4 is provided at the top with a hole 30 to which the shut-off valve 6 is sealed. Fold lines 27, 28 extend from the hole 30 to the welds along the longitudinal edges 15, 16.

Figure 5:
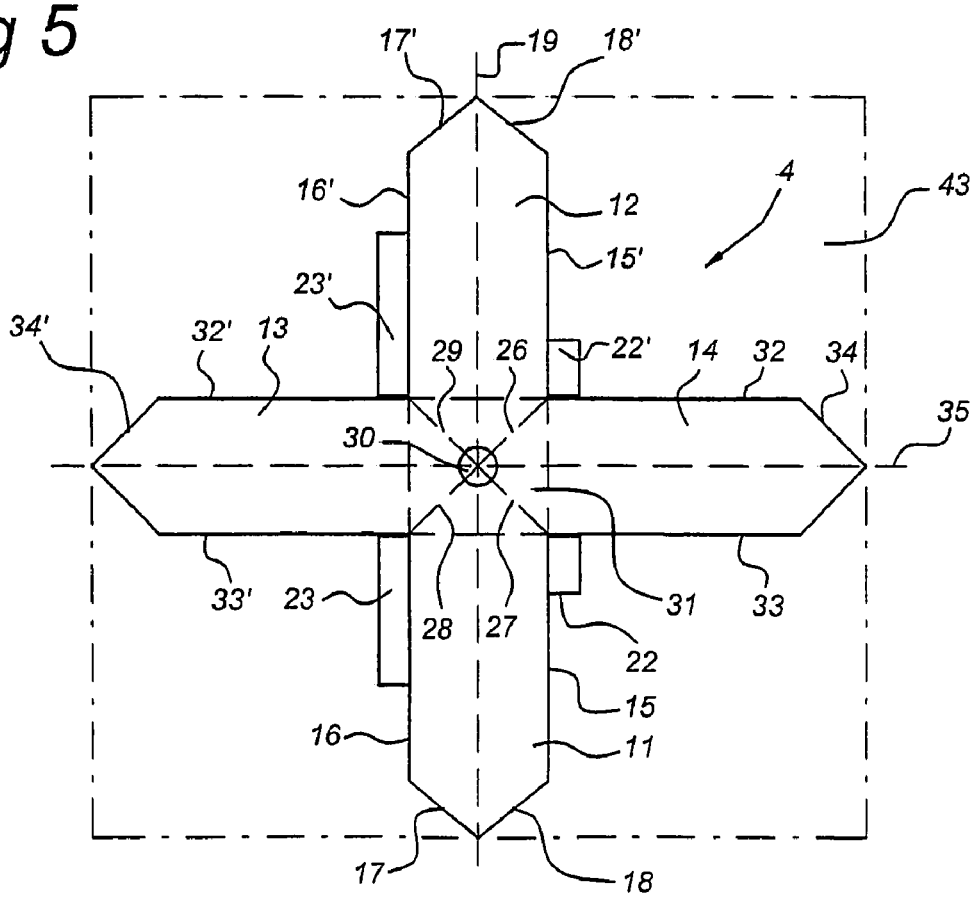
FIG. 5 shows a plan view of a bag according to the invention in the unfolded state.
Figure 6:
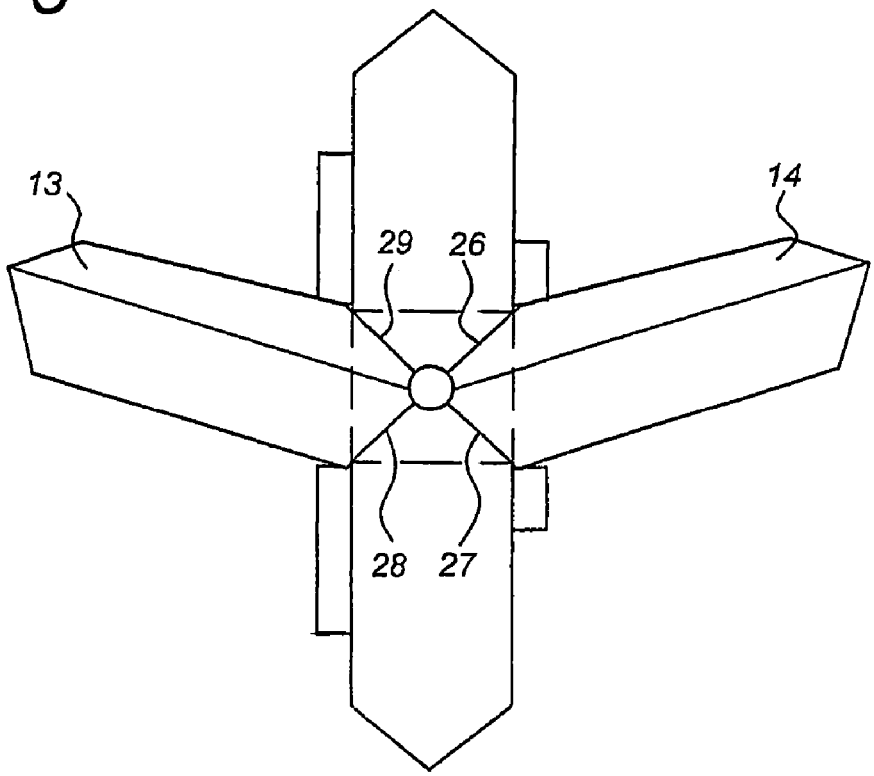
FIG. 6 shows a diagrammatic plan view of the bag according to FIG. 5 in the partially folded state.

FIG. 5 shows the bag 4 in the flat unfolded state. In FIG. 5 the inside of the plastic bag is the view side in the figure. The bag according to FIG. 4 can be made up by cutting out the front, rear and side panels from the sheet 43 of material in accordance with a pattern in the shape of a cross before folding the panels and joining them in accordance with FIGS. 6 and 7. However, it is also possible first to fold the bag from the rectangular sheet 43 and then to cut away the surplus material when welding the longitudinal edges 16, 17 and the end edges 17, 18.

The front and rear panels 11, 12 and the side panels 13, 14 extend in the shape of a cross from a central mid section 31. When making up the bag 4, the side panels 13, 14 are folded double along their centre line 35, the longitudinal edges 32, 33 and 32', 33' being moved towards one another, so that the outsides of the side panel halves are positioned facing one another. The side panels 13, 14 are also folded along fold lines 26-29, as is shown diagrammatically in FIG. 6. The side panels 13, 14 that have been folded double are then placed between the front and rear panels 11, 12, as is shown diagrammatically in FIG. 7, such that longitudinal edges 15, 33; 15', 32; 16, 33'; 16', 32' are coincident.

Figure 7:
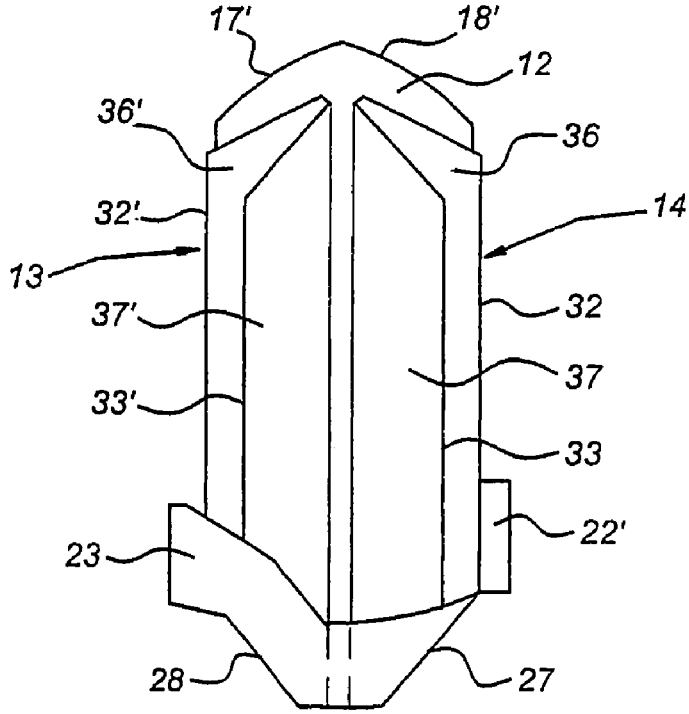
FIG. 7 shows a partially cut-away front view of the bag according to FIG. 5 in the folded state.
Figure 8:
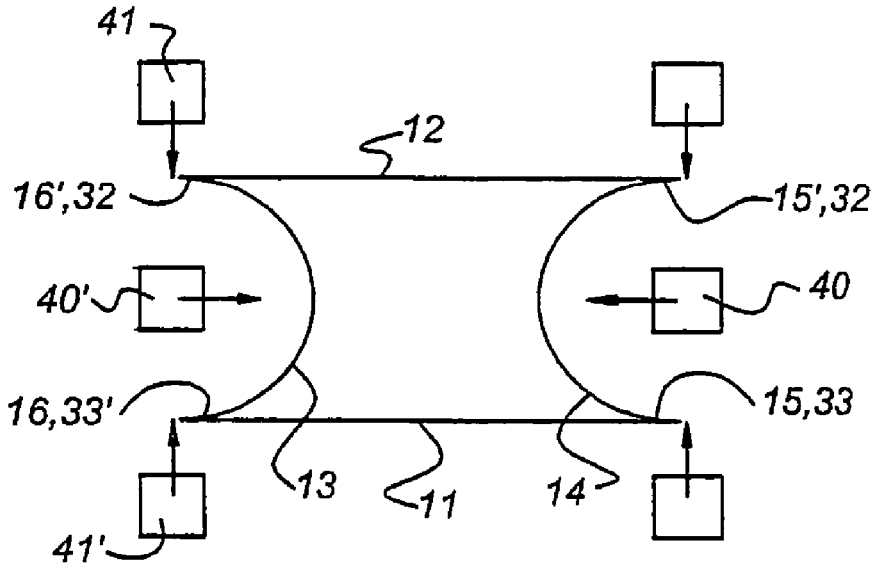
FIG. 8 shows a diagrammatic cross-section of the bag according to FIG. 5 during sealing of the longitudinal edges and end edges.

In FIG. 7 it can clearly be seen how the side panels 13, 14 that have been folded double are superimposed on the rear panel 12. For the sake of clarity, the front panel 11 has been partially cut away in FIG. 7. The outsides 36, 36' of the side panels 13, 14 that have been folded double face one another, whilst the insides 37, 37', where the plastic layer is located, face the front and rear panels 11, 12. From the state shown in FIG. 7, the bag is made up by supplying pressure and heat and making welds along the longitudinal edges 15, 15'; 16, 16'; 32, 32'; 33, 33' and along the end edges 17, 17', 18, 18', 34, 34'. This is shown in FIG. 8, where a welding element 40, 40' folds the side panels 13, 14 along their centre line by moving in the direction of the arrows. A seal between the longitudinal edges 15-33' and between the end edge sections 17, 17', 18, 18', 34, 34' can then be obtained by clamping the longitudinal edges 15, 33; 15', 32; 16, 33'; 16', 32' between welding elements 41, 41' and welding elements 40, 40'.

Figure 9:
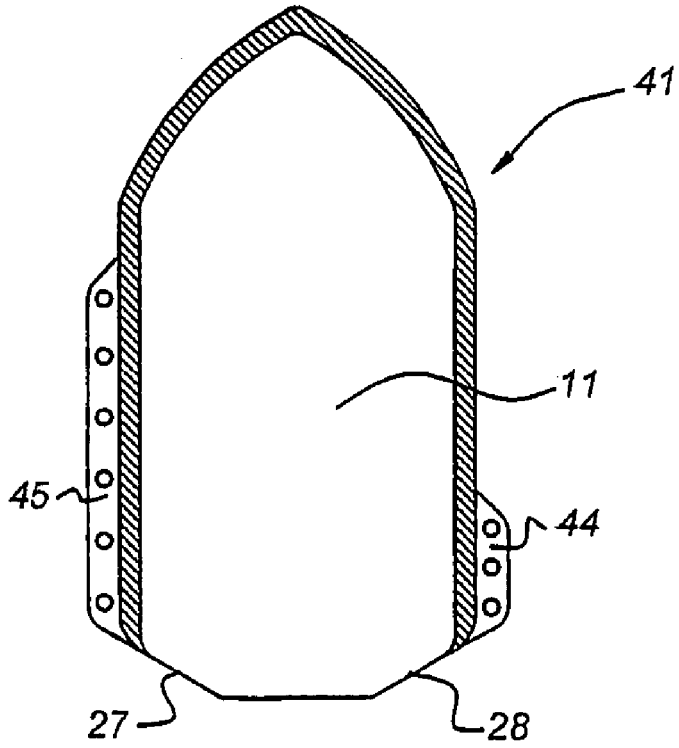
FIG. 9 shows a plan view of a heating element for sealing.

FIG. 9 shows a plan view of the welding element 41 that can comprise a metal strip having the shape of the bag. At the bottom, at the positions of the fastening lips, the welding element 41 is provided with spot welding elements 44, 45 for making the breakable join between the fastening lip parts 22, 22', 23, 23'.

Figure 10:
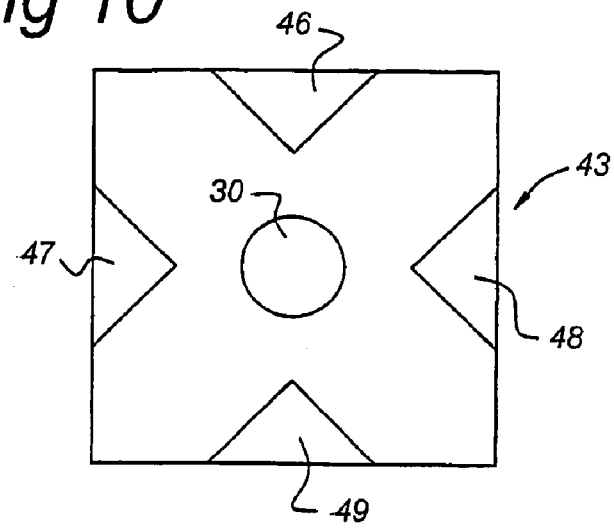
FIG. 10 shows a diagrammatic plan view of the way the bag is made from rectangular film material.

FIG. 10 shows an embodiment where the bag is made from a rectangular sheet 43 of aluminium foil/plastic laminate by punching out material sections 46, 47, 48, 49, before or after folding the bag. The side edge sections of the side panels are formed by the corner points of the rectangular sheet 43.

Figure 11:
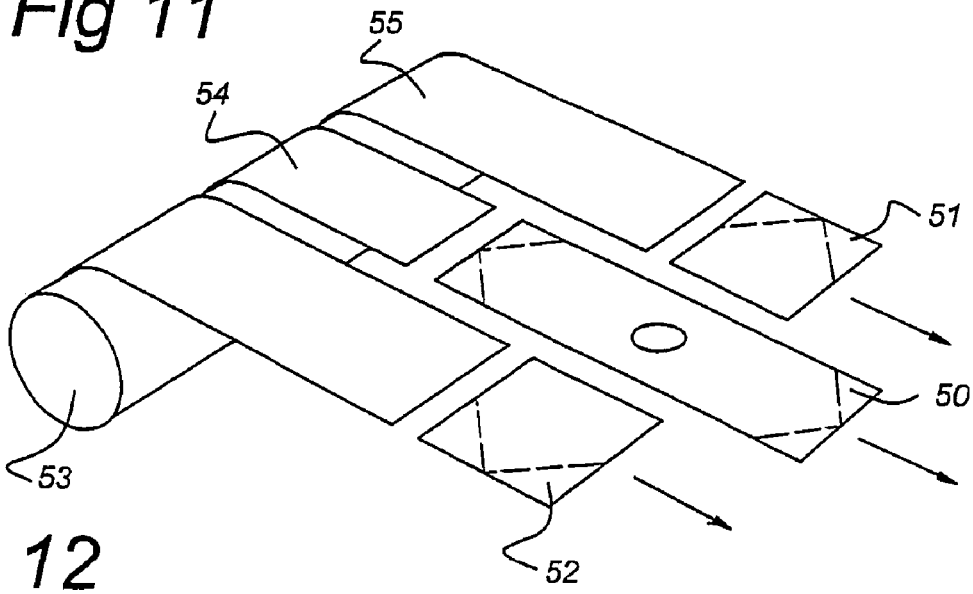
FIG. 11 shows a method for making the bag from three webs of material.
Figure 12:
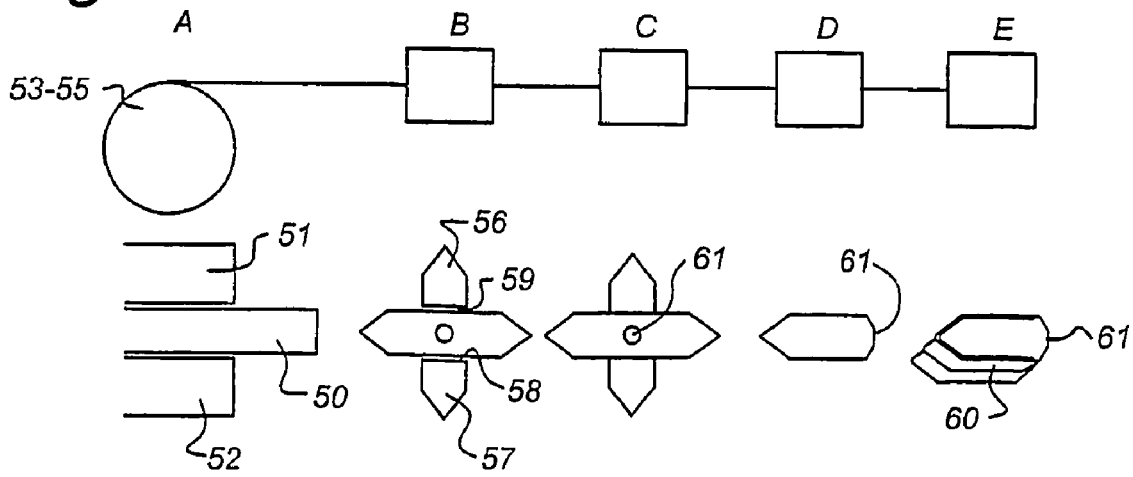
FIG. 12 shows, diagrammatically, the steps in the production process for the bag according to FIG. 11.

An alternative production method where a saving in material of 25% compared with the production method according to FIG. 10 can be obtained is shown in FIGS. 11 and 12. Here the front and rear panel 50, and the side panels 51, 52 are fed from three individual stock rolls 53, 54 and 55. The web of material 50 is relatively narrow, whilst the webs of material 51, 52 are broader but are cut off shorter than the central web 50. As shown in FIG. 12, the webs 50, 51, 52 of material are fed from stock rolls 53-55. In a cutting station B the front and rear panels and the side panels are cut to the correct shape and the side panels 56, 57 are placed with their side edges 58, 59 in contact with the longitudinal edges of the front and rear panels and are welded thereto in welding station C. Downstream of the cutting station B or downstream of welding station C the shut-off valve 6 with the plastic tube connected thereto is inserted in the hole 61 and fixed to the bag material. The front, rear and side panels are then folded in folding station D in accordance with the method that has been described in FIGS. 5-7, after which, in welding station E, the longitudinal edges 15, 33, 15' 32, 16, 33', 16', 32' and the end edge sections 17, 17', 18, 18', 34, 34' are joined to one another using welding elements 60. It is also possible to omit cutting station B and to carry out the cutting step in welding station E, or to feed the side panels 51, 52 as a single web and to join the front and rear panels 50 thereto as separate parts.

The invention claimed is:

1. A bag (4) made of film material, which bag in an unfolded state comprises an essentially rectangular mid section (31), a front panel (11) and rear panel (12) extending from two opposing side edges of the mid section (31), and having, at right angles to the front panel and the rear panel, two side panels (13, 14) that extend from two further side edges of the mid section (31), each said panel (11, 12, 13, 14) being provided with two side edges (15, 16, 15', 16', 32, 33, 32', 33') and with an end edge (17, 18, 17', 18', 33, 34, 33', 34') located some distance away from the mid section, wherein, when the bag is in a folded state, the side panels ace folded along their center line (35), as well as along two fold lines (26, 27, 28, 29) that run from corner points of the mid section (31) located close to the respective side panel into or close to the center of the mid section, so that the side panels are double folded, wherein halves of the side panel located on either side of the center line (35) of the side panels are positioned with their outsides (36, 36') facing one another and wherein the front and rear panels are folded about the center line (35) of the mid section (31) and are positioned with their insides (24, 24') facing one another, wherein the double-folded side panels (13, 14) are located between the front panel and the rear panel (11, 12) the side edges (32, 33, 32', 33') of the side panels (13, 14) are in contact with the adjacent side edges (15, 16, 15', 16') of the front and rear panels (11, 12), and the side panels and the front and rear panels are sealed to one another along the side edges (15, 16, 15', 16', 32, 33, 32', 33') characterized in that the side panels (13, 14) and the front and rear panels (11, 12) are sealed to one another along the end edges (17, 18, 17', 18', 33, 34, 33', 34'), wherein the mid section comprises a hole (30) made in the film material at or close to the center of the mid section (31), for receiving a tube (5) extending in the interior of the bag (4) which tube is connected to a shut-off valve (6) located outside the bag, the shut-off valve adapted for sealing to the periphery of the hole (30), which periphery does not contact any sealed side edges of the side panels.

2. The bag (4) according to claim 1, wherein the end edges (17, 18, 17', 18', 33, 34, 33', 34') of the panels comprises two edge sections extending in the shape of a point from the side edges to the centre line (19, 35) of each panel (11, 12, 13, 14).

3. The bag (4) according to claim 1, wherein the bag comprises a laminate of a metal foil layer and a plastic layer, the plastic layer being located on the inside (24, 24') of the bag, which plastic layer provides the seal between the panels (11, 12, 13, 14) by the application of heat along the side edges (15, 16, 15', 16', 32, 33, 32', 33') and along the end edges (17, 18, 17', 18', 33, 34, 33', 34').

4. The bag (4) according to claim 1, wherein two panels located on either side of the mid section (31) are made from individual pieces of material (56, 57) and are joined to the side edges (59, 60) of the mid section.

5. The bag according to claim 1, wherein the tube and shut-off valve are being sealed to the periphery of the hole.

6. The bag according to claim 1, fit inside a container (1) having a curved base (3) and/or neck (2).

7. The bag (4) according to claim 1, characterised in that two fastening lips (22, 23, 22', 23') are provided along two opposing side edges (15, 16, 15', 16') of a panel, which fastening lips (22, 23, 22', 23') extend laterally with respect to the side edges and are placed on to of one another and joined on one another such that they can come apart.

8. The bag (4) according to claim 7, wherein the fastening lips (22, 23, 22', 23') are formed on the side edges (15, 16, 15', 16') of the front and rear panels (11, 12) and protrude beyond the side edges of the side panels.

9. The bag (4) according to claim 8, wherein the fastening lips (22, 23, 22', 23') run along both side edges (15, 16, 15', 16') of the front and rear panels and have a mutually different length and/or position along the side edges.

* * * * *